US005423649A

United States Patent [19]

Maeda et al.

[11] Patent Number: 5,423,649

[45] Date of Patent: Jun. 13, 1995

[54] APPARATUS FOR CUTTING AND REMOVING PACKAGE MATERIAL

[75] Inventors: Kiichi Maeda; Kozo Yamamoto, both of Yokohama, Japan

[73] Assignee: Kirin Machinery Corporation, Yokohama, Japan

[21] Appl. No.: 333,303

[22] Filed: Nov. 1, 1994

[51] Int. Cl.[6] ..... B65B 69/00

[52] U.S. Cl. ..... 414/412; 53/381.2; 83/402

[58] Field of Search ..... 414/403, 411, 412; 53/381.2, 492; 83/22, 402

[56] References Cited

U.S. PATENT DOCUMENTS

| | | | |
|---|---|---|---|
| 4,158,417 | 6/1979 | Inoue | 53/381.2 |
| 4,245,946 | 1/1981 | McCullough et al. | 414/412 |
| 4,285,625 | 8/1981 | Yamada | 53/381.2 |
| 4,681,507 | 7/1987 | Mojden et al. | 414/412 |
| 4,995,771 | 2/1991 | Sedgeley et al. | 53/381.2 |
| 4,997,329 | 3/1991 | Hanamoto et al. | 83/402 |
| 5,275,524 | 1/1994 | Ishiwata | 414/412 |

*Primary Examiner*—Michael S. Huppert
*Assistant Examiner*—Thomas J. Brahan
*Attorney, Agent, or Firm*—Oblon, Spivak, McClelland, Maier & Neustadt

[57] ABSTRACT

An apparatus for cutting and removing a sheet-bag-like package material from a packaged object which comprises a stack of can ends packaged in the package material. The apparatus comprises a feed unit for feeding the package object along a feeding path, a cutting unit for cutting open a slackened portion of the package material, a removing unit for removing the cut-open package material from the packaged object; and a pushing mechanism for pushing the packaged object toward a stationary stopper disposed at the removing unit. The pushing mechanism includes a movable presser member for pressing a trailing end of the packaged object, a cylinder actuator having a cylinder and a piston, and a spring. One of the cylinder and the piston is connected to the movable presser member and the other of the cylinder and the piston is connected to a stationary member fixedly provided at the removing unit through the spring.

7 Claims, 7 Drawing Sheets

APPARATUS FOR CUTTING AND REMOVING PACKAGE MATERIAL

BACKGROUND OF THE INVENTION

1. Field of the Invention

The present invention relates to an apparatus for cutting and removing a package material from a packaged object, and more particularly to an apparatus for cutting and removing a sheet-bag-like package material from a packaged object which comprises a stack of can ends packaged in the package material.

2. Description of the Related Art

Can ends are attached to open-top cans such as beer cans, soft drink cans or the like. The can ends are superimposed in a cylindrical stack, packaged in a sheet-bag-like package material, and then delivered to a beverage producing process. In the beverage producing process, the package material is removed from a packaged object including a cylindrical stack of can ends, and one of the can ends, at a time, is supplied to an open-top can which has been filled with beverage such as beer. Then, the can end is placed over the open-top of the cylindrical can and attached thereto by seaming.

U.S. Pat. No. 5,275,524 discloses an apparatus for cutting and removing a package material from a packaged cylindrical object including a cylindrical stack of can ends. The disclosed apparatus comprises a feed unit having a pusher for feeding a packaged object in a longitudinal direction, one by one, by a pusher, a package cutting unit for forming, under vacuum, a loop-like slackened portion of the package material in a longitudinal direction of the packaged object and for cutting open the slackened portion, a package removing unit for removing the cut-opened package material by a pair of rollers from the package object which has been supplied thereto by the pusher having a constant stroke, and a delivery unit for delivering the stack of the can ends from the package removing unit to a delivery conveyor.

The disclosed apparatus is designed to handle only such a packaged object, having an approximately constant length, which is formed by stacking a predetermined number of flat can ends which adhere closely to one another. Therefore, the pusher for pushing the trailing end of the packaged object has a constant stroke. In the case where the respective packaged objects have variations in number of can ends and are elastic due to their complicate shape of the can ends, when the packaged object which has been cut open is fed into the removing unit, the Gap is formed between the forward end of the packaged object and the forward-side stopper fixedly provided on the apparatus, or the packaged object is excessively compressed by the pusher.

In the former case, since the packaged object cannot be properly supported by the forward-side stopper and the rear-side stopper, the can ends are scattered in pieces after removing the package material. In the latter case, the can ends are also scattered in pieces due to restitution of the compressed can ends after removing the package material.

Further, the disclosed apparatus cannot cut open the package material having a folded portion, so-called "flap fold" at one end thereof. To be more specific, as shown in FIG. 8A, a packaged object 1 is formed by inserting a stack of can ends 3 into a sheet-bag-like package material 2 whose open end is folded back, and then sticking an adhesive tape 4 onto the folded portion and the circumferential surface of the package material 2 as shown in FIG. 8B. The disclosed apparatus cannot deal with the packaged object 1 as shown in FIGS. 8A and 8B because it is difficult to form an upwardly slackened portion at the upper portion of the package material under the vacuum created by a suction device due to overlap of the folded portion and to thus cut open the folded portion by the cutter.

Furthermore, the disclosed apparatus is designed to handle only relatively short packaged objects. In case of the short packaged object, the can ends are not scattered in pieces when discharged from the removing unit. However, in case of the long packaged object, the can ends are likely to be scattered in pieces at the central portion thereof when discharged from the package removing unit.

SUMMARY OF THE INVENTION

It is therefore an object of the present invention to provide an apparatus for cutting and removing a package material from a packaged object, which can locate the packaged object at a predetermined position in a package removing unit and can prevent a cylindrical stack of can ends from being scattered in pieces after removing the package material or when discharged from the package removing unit.

Another object of the present invention is to provide an apparatus for cutting and removing a package material from a packaged object, which can prevent the folded portion of the package material from being cut open and can improve the throughput of the apparatus.

According to one aspect of the present invention, there is provided an apparatus for cutting open and removing a sheet-like package material from a packaged object comprising can ends packaged in the package material, the apparatus comprising: means for feeding the package object along a feeding path in a longitudinal direction thereof; means for creating vacuum condition which is disposed along the feeding path and provided with a suction opening, the vacuum creating means drawing upwardly the package material of the packaged object to form a loop-like slackened portion of the package material extending in the longitudinal direction of the packaged object; a cutter disposed in the vacuum creating means near the suction opening and adapted to cut open the slackened portion of the package material; means for removing the cut-open package material from the packaged object; and means for pushing the packaged object toward a stationary stopper disposed at the removing means, the pushing means including a movable presser member for pressing a trailing end of the packaged object, a cylinder actuator having a cylinder and a piston, and a spring; wherein one of the cylinder and the piston is connected to the movable presser member and the other of the cylinder and the piston is connected to a stationary member fixedly provided at said removing means through the spring.

According to the above structure, the packaged object is placed between the stationary stopper and the movable presser member. Since the packaged objects have variations in length, the packaged object cannot be placed at a predetermined position of the removing means. By actuating the pushing means, the packaged object is pushed forward to thus locate the packaged object at a predetermined position of the removing means. Since only the spring-load of the spring is applied to the packaged object, the packaged object is not excessively pushed and is not compressed.

According to another aspect of the present invention, there is provided an apparatus for cutting open and removing a sheet-like package material from a packaged object comprising can ends packaged in the package material, the apparatus comprising: means for feeding the package object along a feeding path in a longitudinal direction thereof; means for creating vacuum condition which is disposed along the feeding path and provided with a suction opening, the vacuum creating means drawing upwardly the package material of the packaged object to form a loop-like slackened portion of the package material extending in the longitudinal direction of the packaged object; a cutter disposed in the vacuum creating means near the suction opening and adapted to cut open the slackened portion of the package material; means for removing the cut-open package material from the packaged object; and means for delivering an unpackaged object to a discharge conveyor, the delivering means including an inclined shoot, at least one stopper disposed at an intermediate portion of the inclined shoot, and guide means for guiding the unpackaged object from the stopper to the discharge conveyor; wherein the guide means comprises a trough-like guide member for holding the unpackaged object, a lateral cylinder actuator for moving the guide member between the stopper and the discharge conveyor, and a vertical cylinder actuator for moving the guide member toward and away from the unpackaged object.

According to the above structure, when delivering a cylindrical stack of can ends from the removing unit to the discharge conveyor through the inclined shoot, the stack of the can ends can be moved while holding the upper portion of the can ends and guiding the same by the guide member. Thus, the stack of the can ends can be prevented from being scattered in pieces by the guide member during delivery.

According to still another aspect of the present invention, there is provided an apparatus for cutting open and removing a sheet-like package material from a packaged object comprising can ends packaged in the package material, the apparatus comprising: means for feeding the packaged object along a feeding path in a longitudinal direction thereof, the feeding means including a pusher for pushing a trailing end of the packaged object; means for lowering the pusher so that the pusher returns to its original position below a succeeding packaged object to be pushed by said pusher, the lowering means including cam grooves comprising an upper and a lower cam grooves and connecting cam grooves for connecting the upper cam groove and the lower cam groove at both ends thereof, a cam follower provided on the pusher and movable in the cam grooves, and switching guides disposed at the respective junctions of three grooves for switching moving direction of the cam follower so that the cam follower moves along a return path different from a forward path; means for creating vacuum condition which is disposed along the feeding path and provided with a suction opening, the vacuum creating means drawing upwardly the package material of the packaged object to form a loop-like slackened portion of the package material extending in the longitudinal direction of the packaged object; a cutter disposed in the vacuum creating means near the suction opening and adapted to cut open the slackened portion of the package material; and means for removing the cut-open package material from the packaged object.

According to the above structure, the cam follower provided on the pusher moves along the return path different from the forward path. The cam grooves includes an upper cam groove and a lower cam groove to cause the cam follower to displace vertically. The cam follower is provided on the pusher to lower the pusher at the return path. Therefore, the succeeding packaged object can be supplied to the feed unit before the pusher returns to its original position, thus improving the throughput of the apparatus.

According to still another aspect of the present invention, there is provided an apparatus for cutting open and removing a sheet-like package material from a packaged object comprising can ends packaged in the package material, the apparatus comprising: means for feeding the package object along a feeding path in a longitudinal direction thereof; means for positioning the packaged object having a folded portion on a circumferential surface of the package material, the positioning means including a pair of parallel elongate rollers for rotating the packaged object about a longitudinal axis thereof, and a sensor for detecting the folded portion of the packaged object; means for creating vacuum condition which is disposed along the feeding path and provided with a suction opening, the vacuum creating means drawing upwardly the package material of the packaged object to form a loop-like slackened portion of the package material extending in the longitudinal direction of the packaged object; a cutter disposed in the vacuum creating means near the suction opening and adapted to cut open the slackened portion of the package material; and means for removing the cut-open package material from the packaged object.

According to the above structure, while rotating the packaged object by the rollers, the folded portion of the package material is detected by the sensor, and the portion other than the folded portion is positioned upwardly. Therefore, the folded portion is not cut open, and thus there is no cutting error.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENT

An apparatus for cutting and removing package material according to an embodiment of the present invention will be described below with reference to FIGS. 1 through 8A and 8B.

Figure 1:
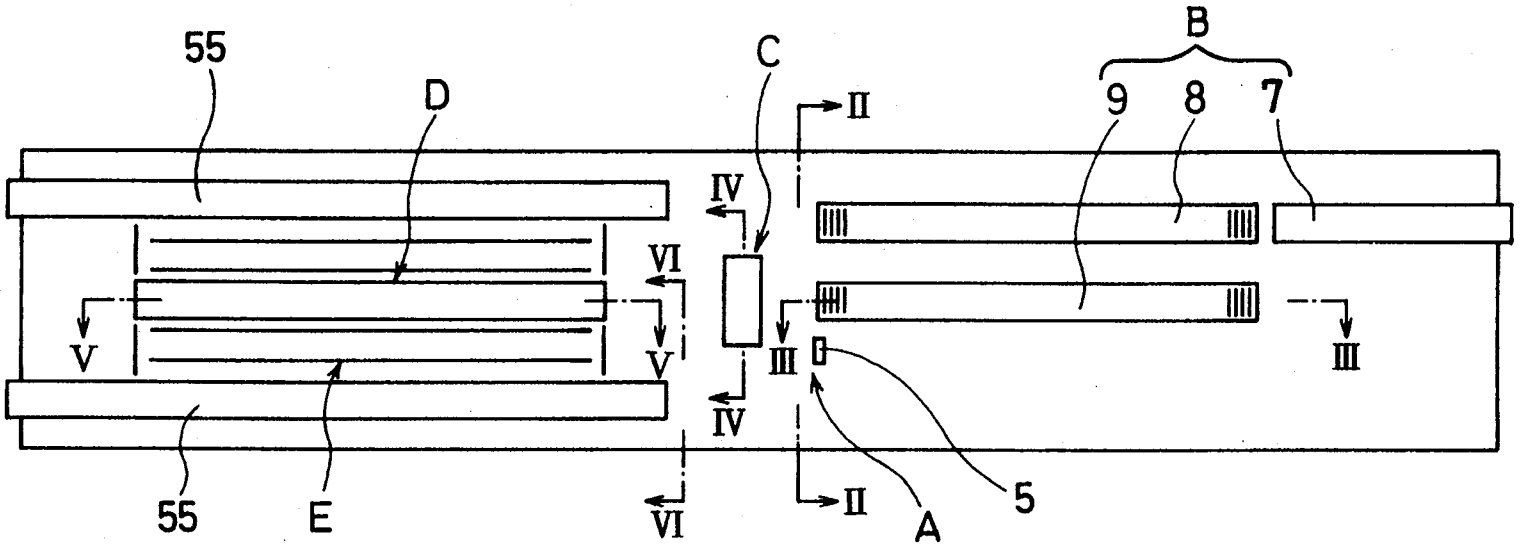
FIG. 1 is a plan view of an apparatus for cutting and removing package material according to an embodiment of the present invention.

FIG. 1 shows the whole structure of an apparatus for cutting and removing package material (hereinafter referred to as the apparatus), according to the present invention. In FIG. 1, a packaged cylindrical object 1 (see FIGS. 8A and 8B) comprising a cylindrical stack of can ends 3 packaged in a sheet-bag-like package material 2 moves from the right to the left. The apparatus has a bed for supporting several units which has a falling gradient of approximately 12 degrees toward a moving direction of the packaged object 1 so that the can ends 3 do not fall flat after the package material 2 has been removed. The apparatus includes a positioning unit A for detecting the folded portion of the packaged object 1 and locating the packaged object 1 at a predetermined position, a feed unit B disposed at the upstream side of the apparatus for feeding the packaged object 1, and a package cutting unit C disposed substantially centrally in the apparatus, for cutting open the package material 2. The apparatus also includes a package removing unit D disposed downstream of the package cutting unit C for removing the opened package material 2 from the packaged object 1, and a delivery unit E disposed along the package removing unit D, for delivering an unpackaged object 1 from the package removing unit D.

Figure 2:
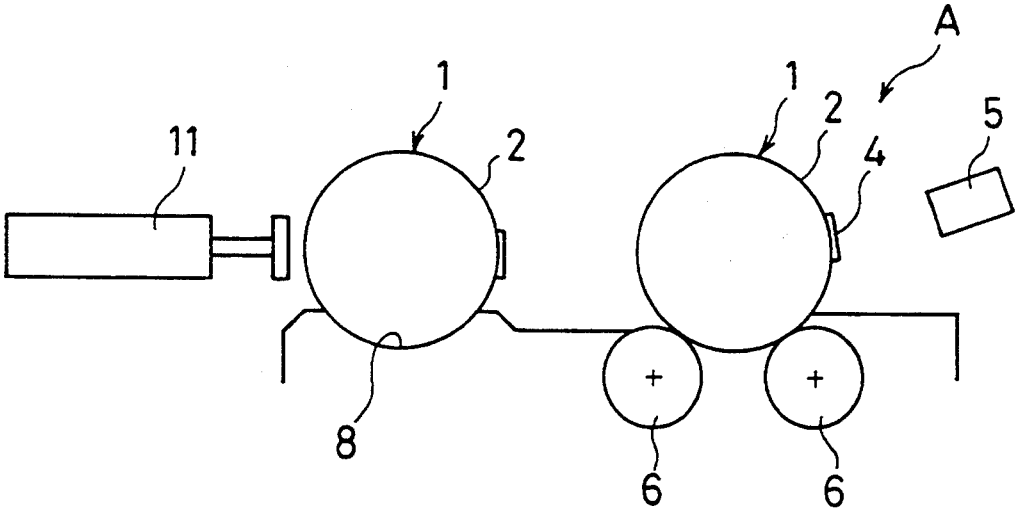
FIG. 2 is a view as viewed from line II—II of FIG. 1.

As shown in FIG. 2, the positioning unit A incorporated in the apparatus comprises a sensor 5 for detecting the adhesive tape 4 attached to the folded portion at one end of the packaged object 1, and a pair of rollers 6 for rotating the packaged object 1. In the positioning unit A, while rotating the packaged object 1 by the rollers 6, the adhesive tape 4 is detected by the sensor 5, and then the rollers 6 are stopped to position a predetermined portion of the package material 2, which can be easily cut and does not correspond to the folded portion, upward.

The feed unit B serves to move the packaged object 1 through the package cutting unit C to the package removing unit D. As shown in FIG. 1, the feed unit B comprises a supply section 7 located at the inlet of the apparatus, a standby section 8 disposed directly downstream of the supply section 7, and a feed section 10 disposed laterally of and adjacent to the standby section 8. The supply section 7 comprises a timing belt for placing thereon and conveying the package object 1 and serves to supply the packaged object 1 intermittently to the standby section 8 in cooperation with a stopper mechanism (not shown). As shown in FIG. 2, an air cylinder 11 is provided in the standby section 8 to supply the packaged object 1 from the standby section 8 onto the rollers 6.

Figure 3:
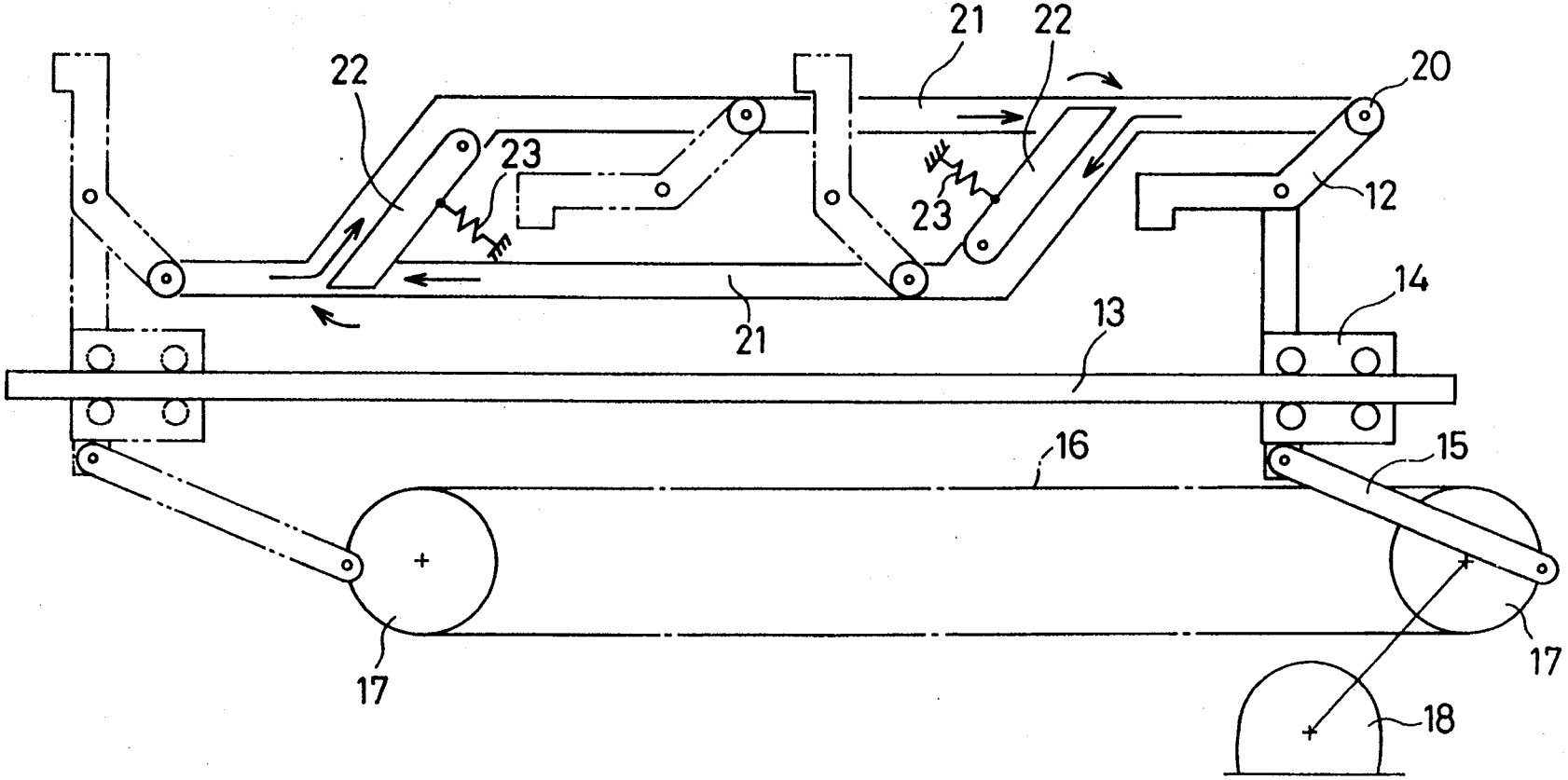
FIG. 3 is a cross-sectional view taken along line III—III of FIG. 1.

The feed section 9 has a pusher 12 for pushing the trailing end of the packaged object 1 placed on the rollers 6 as shown in FIG. 3. The pusher 12 is coupled to a slider 14 which is slidable along a guide rail 13. The slider 14 is coupled to an endless chain 16 through a link 15. The chain 16 is provided between a pair of sprockets 17, one of which is driven by a motor 18. The pusher 12 has a cam follower 20, at a rear end thereof, which is movable in cam grooves 21 comprising an upper and a lower cam grooves and connecting grooves for connecting the upper cam groove and the lower cam groove at both ends thereof. Switching guides 22 are provided at the respective Junctions of three grooves. Each of the switching guide 22 is swung by the cam follower 20 and returned to its original position by a spring 23. Therefore, when the pusher 12 moves forward as shown by an arrow, the cam follower 20 is moved along the lower cam groove to raise the pusher 12, so that the pusher 12 pushes the trailing end of the packaged object 1 placed on the rollers 6. When the pusher 12 moves backward, the cam follower 20 moves along the upper cam groove as shown by an arrow to lower the pusher 12, so that the pusher 12 can move backward below the succeeding packaged object 1 placed on the rollers 6.

Figure 4A:
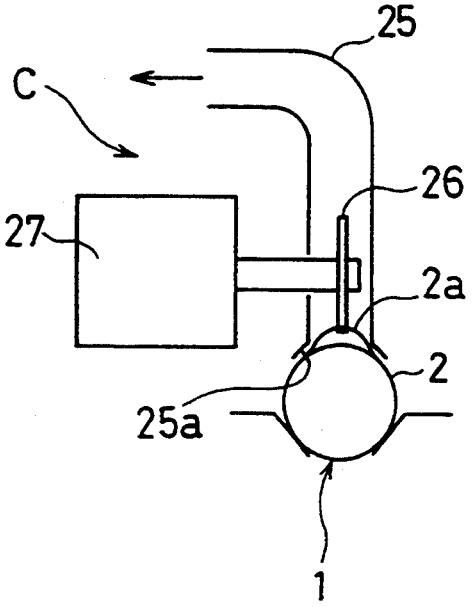
FIG. 4A is a cross-sectional view taken along line IV—IV of FIG. 1.
Figure 4B:
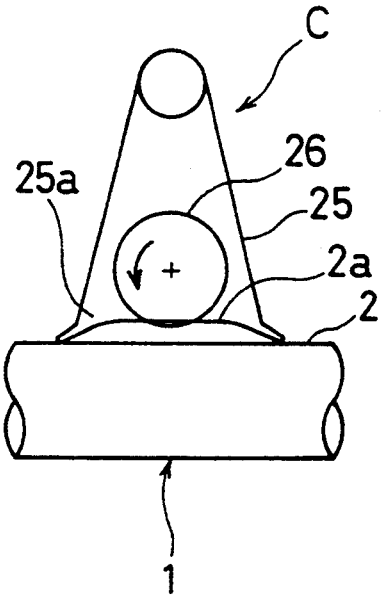
FIG. 4B is a cross-sectional view of the package cutting unit of FIG. 4A.

As shown in FIGS. 4A and 4B, the package cutting unit C has a suction duct 25 connected to a vacuum sauce (not shown) such as an air blower and having a suction port **25*a* opening downwardly for contacting and drawing an upper surface of the packaged object 1 to form an upwardly slackened portion 2*a* which extends longitudinally of the package material 2 when the vacuum sauce is actuated. The package cutting unit C also includes a cutter 26 adjacent to the suction port 25*a*, for cutting open the upwardly slackened portion 2*a* of the package material 2. The cutter 26 is connected to a motor 27**.

Figure 5:
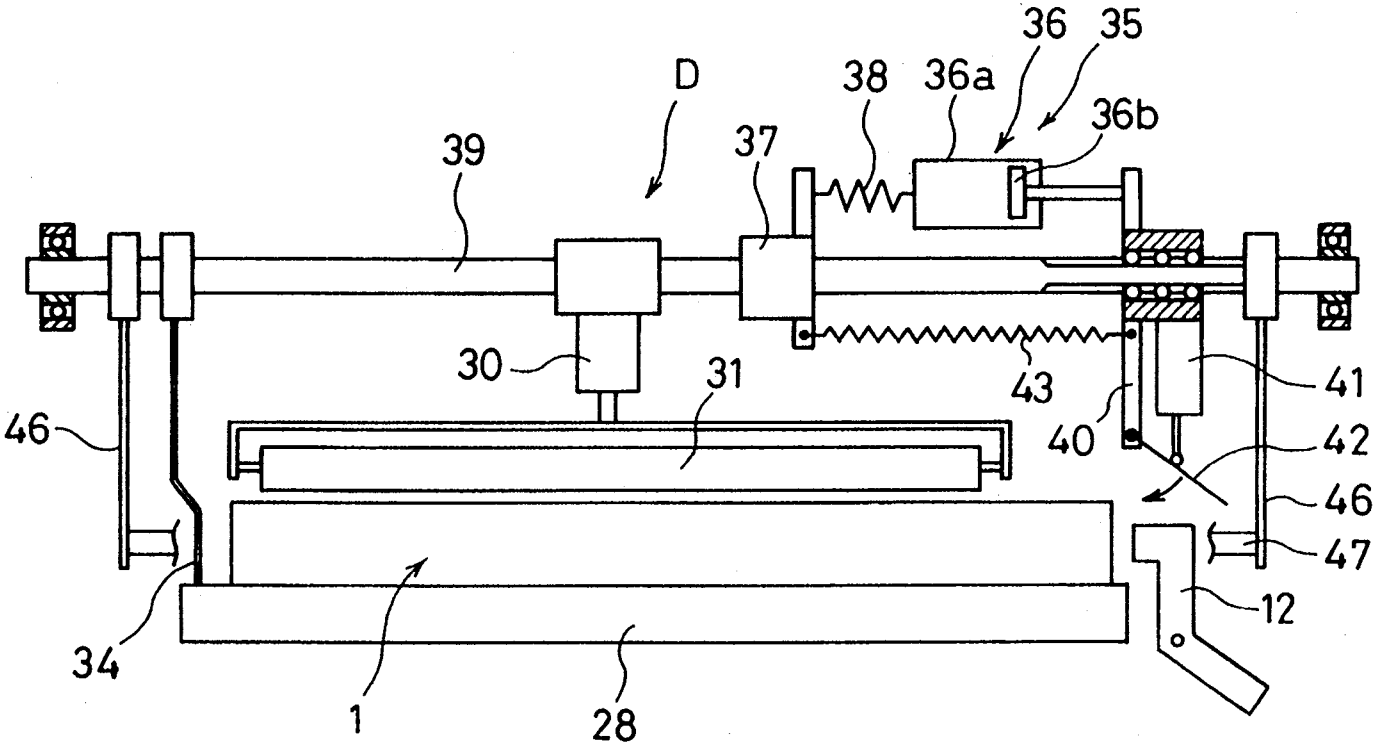
FIG. 5 is a cross-sectional view taken along line V—V of FIG. 1.
Figure 6:
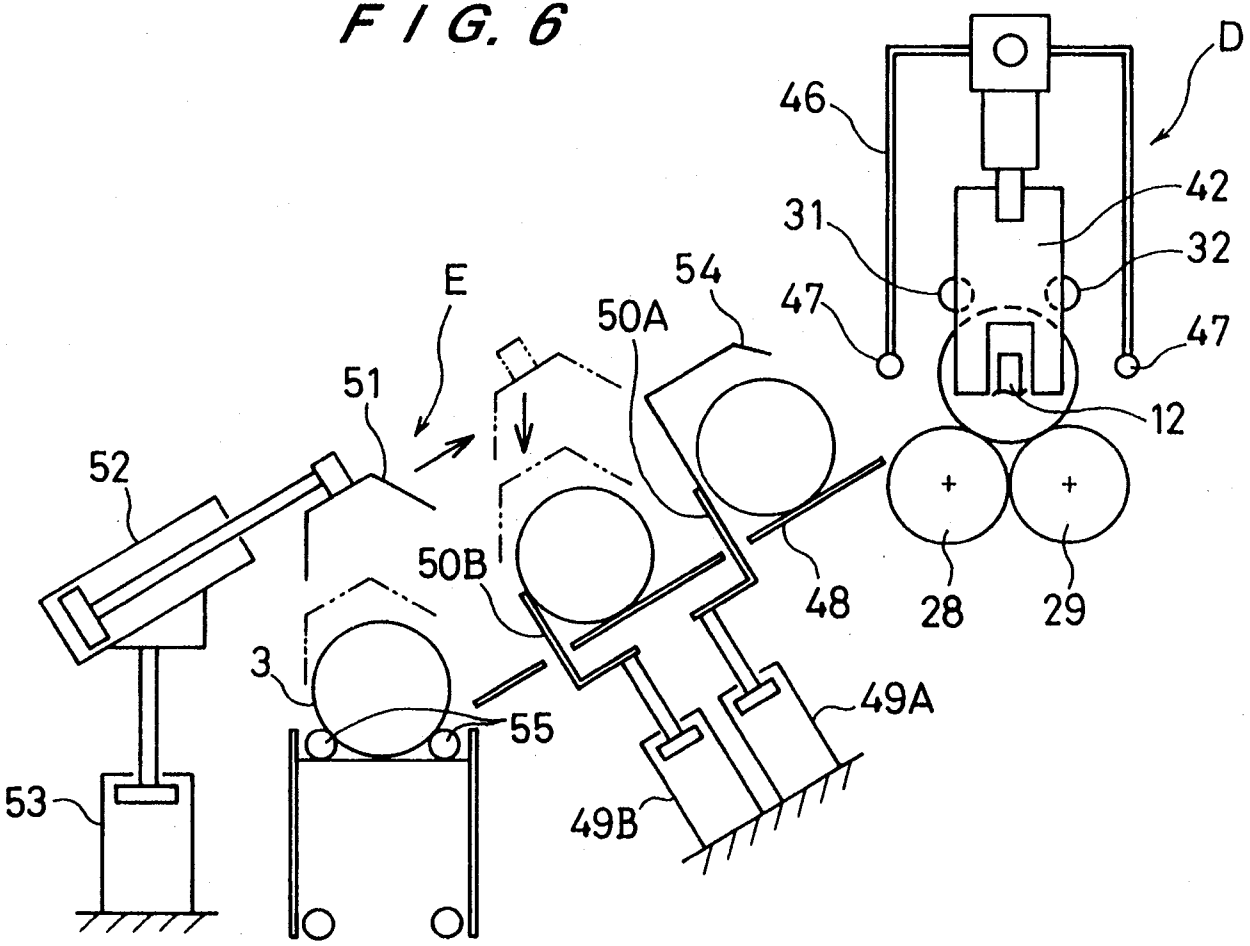
FIG. 6 is a view as viewed from line VI—VI of FIG. 1.

As shown in FIGS. 5 and 6, the package removing unit D has a pair of parallel elongate stripper rollers 28 and 29 whose outer circumferential surfaces are held against each other and which are rotatable in opposite directions. In the package removing unit D, the packaged object 1 with the package material 2 that has been cut open is placed on the stripper rollers 28 and 29 to remove the package material 2 from the packaged object 1. The package removing unit D also has a pair of motor rollers 31 and 32 for contacting the upper surface of the packaged object 1 and feeding the package material 2 downwardly to prevent the package material 2 from being not stripped. The motor rollers 31 and 32 are vertically movable by an air cylinder 30.

The apparatus according to the present invention handles the packaged objects 1 having variations in length. The packaged object 1 cannot be placed at a predetermined position of the package removing unit D only by the pusher 12 having a constant stroke. Therefore, as shown in FIG. 5, a pushing mechanism 35 is provided to move the packaged object 1 forward in the package removing unit D. By actuation of the pushing mechanism 35, the packaged object 1 is pushed forward and the forward end of the packaged object 1 contacts a stationary stopper 34 provided at the forward end of the package removing unit D, and further the packaged object 1 is pressed at a desired force against the stationary stopper 34.

As shown in FIG. 5, the pushing mechanism 35 comprises a cylinder actuator 36, a coiled spring 38 for connecting a cylinder **36*a* of the cylinder actuator 36 to a stationary member 37 fixedly provided on the apparatus, and a movable presser member 40 which is coupled to a piston 36*b* of the cylinder actuator 36 and movable along a shaft 39. The movable presser member 40 has a swing plate 42 which is connected to an air cylinder 41 and movable toward and away from the trailing end of the packaged object 1. A coiled spring 43 is provided between the movable presser member 40 and the stationary member 37**.

Next, operation of the pushing mechanism 35 will be described briefly. The packaged object 1 is fed to the package removing unit D by the pusher 12. Since the packaged objects 1 have variations in length, components in the package removing unit D are designed so as to form a certain gap between the forward end of the packaged object 1 and the stationary stopper 34 when the packaged object 1 is fed to the package removing unit D by the pusher 12. The air cylinder 41 serves to swing the swing plate 42, and the swing plate 42 contacts the trailing end of the packaged object 1 before the pusher 12 is brought out of contact with the packaged object 1.

Thereafter, a compressed air is supplied to the cylinder actuator 36 to cause the piston **36*b* of the cylinder actuator 36 to move to the left side, and the movable presser member 40 and the swing plate 42 move forward, thus the swing plate 42 pushes the packaged object 1 forward. Since the cylinder 36*a* of the cylinder actuator 36 is connected to the stationary member 37 through the coiled spring 38, only spring-load of the coiled spring 38 is applied to the packaged object 1 during a forward movement of the packaged object 1. After the forward end of the packaged object 1 contacts the stationary stopper 34, the packaged object 1 is continuously pushed forward by the swing plate 42 of the movable presser member 40. At this time, only spring-load of the coiled spring 38 is applied to the packaged object 1. Thus, the packaged object 1** is not excessively pushed and is not compressed.

After the forward end of the packaged object 1 reaches the stationary stopper 34, an electromagnetic valve (not shown) for controlling the cylinder actuator 36 is opened to apply atmospheric pressure to the cylinder actuator 36. Thus, the pressing force which has been applied to the movable presser member 40 by the cylinder actuator 36 is released. However, since the coiled spring 43 is provided between the stationary member 37 and the movable presser member 40, a weak spring-load is applied to the packaged object 1, and the packaged object 1 is held by the stationary stopper 34 and the movable presser member 40. In this state, the stripper rollers 28 and 29 and the motor rollers 31 and 32 are rotated to thus remove the package material 2 from the packaged object 1.

Figure 7:
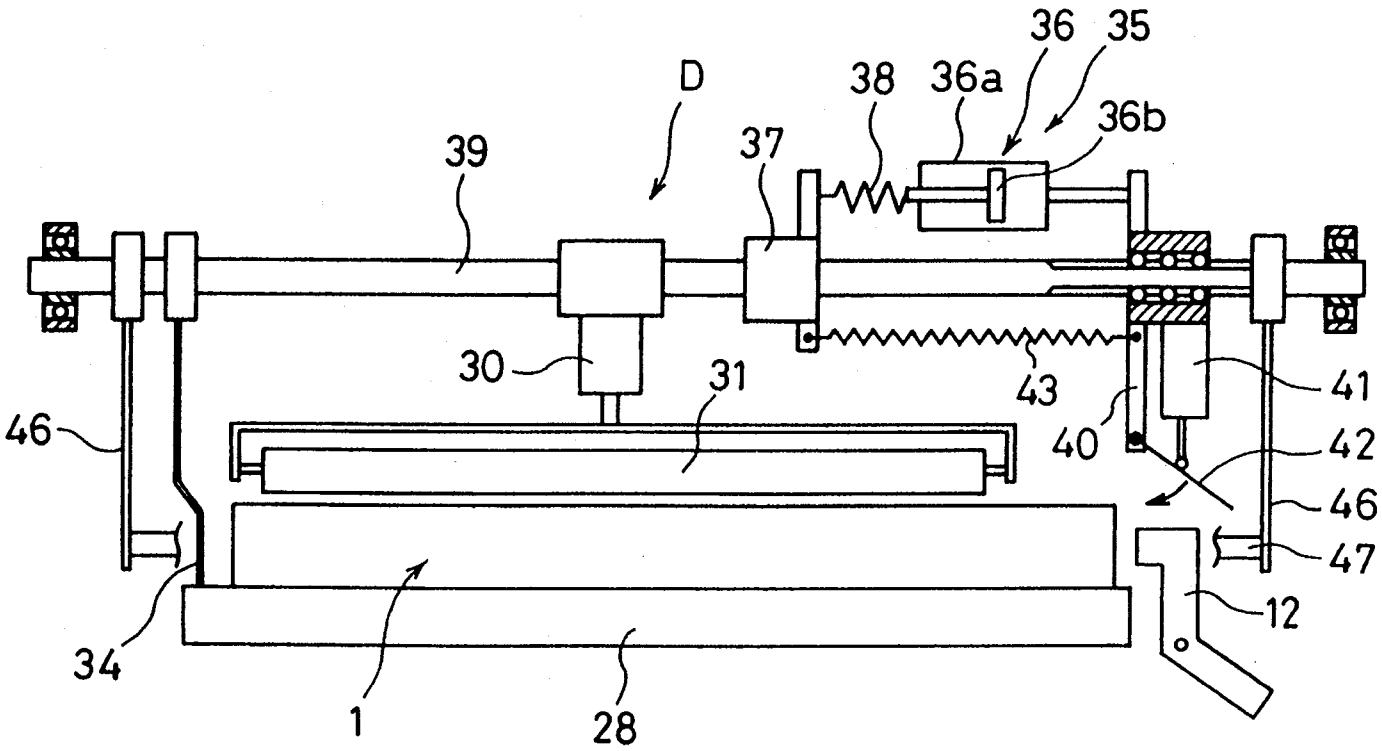
FIG. 7 is a cross-sectional view showing a modified embodiment, corresponding to FIG. 5.
Figure 8A:
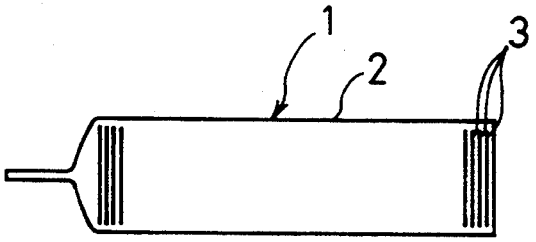
FIGS. 8A and 8B are views showing a packaged object which comprises a stack of can ends packaged in a sheet-bag-like package material processed by the apparatus of the present invention.
Figure 8B:
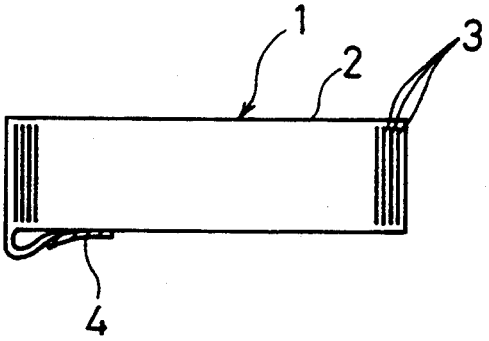

FIG. 7 shows a modified embodiment of the pushing mechanism 35. In this embodiment, the movable presser member 40 is connected to the cylinder **36*a* of the cylinder actuator 36, and the piston 36*b* is connected to the stationary member 37 through the coiled spring 38. Operation of the pushing mechanism 35 in FIG. 7 is the same as that in FIG. 5**.

Next, the delivery unit E for delivering an unpackaged object from the package removing unit D to a discharge conveyor 55 will be described below. As shown in FIGS. 5 and 6, the delivery unit E comprises inverse-U shaped swing plates 46 fixed to both ends of the shaft 39, two discharge bars 47 provided between the swing plates 46, an inclined shoot 48 on which the stack of the can ends 3 moves, stoppers 50A and 50B for stopping the stack of the can ends 3, movable up and down by respective air cylinders 49A and 49B, disposed at the intermediate portions of the inclined shoot 48, and a trough-like guide member 51 for guiding the cylindrical stack of the can ends 3 so as not to be scattered in pieces. The guide member 51 is coupled to a lateral air cylinder 52 and a vertical air cylinder 53. The guide member 51 is movable between the stopper 50B and the discharge conveyor 55 by the lateral air cylinder 52, and movable toward and away from the can ends 3 by the vertical air cylinder 53.

According to the delivery unit E of the above structure, the discharge bar 47 is swung by the rotation of the shaft 39, and the cylindrical stack of the can ends 3 on the stripper rollers 28 and 29 is delivered to the inclined shoot 48. The stack of the can ends 3 moves on the inclined shoot 48, and stops at the stopper 50A. Thereafter, the stopper 50A is lowered, the cylindrical stack of the can ends 3 moves further on the inclined shoot 48, and stops at the stopper 50B. When the stopper 50A is lowered, a contact member 54 provided at one end of the stopper 50A contacts the upper portion of the cylindrical stack of the can ends 3. Thus, the stack of the can ends 3 is pushed by the contact member 54, and thus moves smoothly toward the stopper 50B.

Thereafter, the vertical air cylinder 53 and the lateral air cylinder 52 are actuated to cause the guide member 51 to contact the cylindrical stack of the can ends 3, the stopper 50B is then lowered, and the guide member 51 is moved obliquely downwardly. As a result, the cylindrical stack of the can ends 3 is delivered onto the discharge conveyor 55 while held by the guide member 51. Thereafter, the can ends 3 are supplied to a seamer by the discharge conveyor 55. Although the delivery unit E at the left side is shown in FIG. 6, the delivery unit E at the right side has the same structure as that of the left side. The cylindrical stack of the can ends 3 can be selectively delivered onto the discharge conveyors 55 at both sides.

The whole operation of the apparatus will now be described below. The packaged object (packaged can-end stack) 1 is supplied from an upstream conveyor to the supply section 7 of the feed unit B. If there is a preceding packaged object 1 in the standby section 8, then the packaged object 1 supplied to the supply section 7 is held in the supply section 7 by the stopper mechanism. If there is no preceding packaged object 1 in the standby section 8, the stopper mechanism is released to feed the supplied packaged object 1 into the standby section 8.

If there is no preceding the packaged object 1 in the feed section 9, the air cylinder 11 is actuated to shift the packaged object 1 laterally from the standby section 8 onto the feed section 9. In the positioning unit A, the packaged object 1 is rotated by rotating the rollers 6, the adhesive tape 4 is detected by the sensor 5, and the rollers 6 are stopped to position a predetermined portion of the package material 2, which can be easily cut open, upward.

The pusher 12 is then actuated to push the trailing end of the packaged object 1 forward. When the forward end of the packaged object 1 reaches a position below the suction port **25*a* of the package cutting unit C, upward suction forces are applied to the packaged object 1 from the vacuum source through the suction duct 25. As shown in FIGS. 4A and 4B, the package material 2 now forms an upwardly slackened portion 2*a* in the upper region of the packaged object 1 under the vacuum created in the suction duct 25. On continued downstream travel of the packaged object 1, the upwardly slackened portion 2*a* is continuously extended in the longitudinal direction of the packaged object 1. At the same time, the upwardly slackened portion 2*a* is continuously cut open in the longitudinal direction by the cutter 26**.

After the upwardly slackened portion 2*a* is continuously cut open by the cutter 26, the packaged object 1 is continuously pushed downstream by the pusher 12 onto the stripper rollers 28 and 29 of the package removing unit D. Since the packaged objects 1 have variations in length, the packaged object 1 cannot be placed at a predetermined position in the package removing unit D. Therefore, the cylinder actuator 36 of the pushing mechanism 35 is actuated, and the packaged object 1 is pushed downstream by the movable presser member 40 and the forward end of the packaged object 1 contacts the stationary stopper 34. At this time, only spring-load of the coiled spring 38 is applied to the packaged object 1, therefore the packaged object 1 is not excessively pressed by the movable presser member 40 and is not compressed.

After finishing forward movement of the pusher 12, the pusher 12 returns to its original position in such a state that the pusher 12 descends and moves below the succeeding packaged object 1, on the rollers 6, to be pushed by the pusher 12. After the forward end of the packaged object 1 reaches the stationary stopper 34, the electromagnetic valve for controlling the cylinder actuator 36 is opened to apply atmospheric pressure to the cylinder actuator 36. Thus, the pressing force which has been applied to the movable presser member 40 by the cylinder actuator 36 is released. The packaged object 1 is held between the stationary stopper 34 and the movable presser member 40 by a weak spring-load of the coiled spring 43.

The stripper rollers 28 and 29 are then rotated in opposite directions to start removing the package material 2 of the packaged object 1 in cooperation with the motor rollers 31 and 32. The cylindrical stack of the can ends 3 is delivered onto the inclined shoot 48 by swinging motion of the discharge bar 47 in the delivery unit E. The cylindrical stack of the can ends 3 is fed to the discharge conveyor 55 while guided by the guide member 51 without being scattered in pieces, and the can ends are then delivered by the discharge conveyor 55 to the seamer (not shown) where one of the can ends 3, at a time, is successively seamed on respective cylindrical can bodies.

As is apparent from the above description, according to the present invention, even if the packaged objects have variations in length and a cylindrical stack of can ends is elastic, the packaged object can be placed at a predetermined position in a package removing unit and an excessive force is not applied to the packaged object at the package removing unit. Therefore, the stack of can ends can be prevented from being scattered in pieces after removing package material.

Further, according to the present invention, after removing package material from the packaged object, an elongated stack of can ends can be prevented from being scattered in pieces when discharged from the package removing unit.

Furthermore, according to the present invention, before cutting open the package material, the folded portion of the package material is detected, and the portion other than the folded portion is positioned upwardly. Therefore, the folded portion is not cut open, and there is no cutting error. Further, since the pusher has a return path different from a forward path, the succeeding packaged object can be supplied to the feed unit before the pusher returns to its original position, thus improving the throughput of the apparatus.

Although certain preferred embodiments of the present invention has been shown and described in detail, it should be understood that various changes and modifications may be made therein without departing from the scope of the appended claims.

What is claimed is:

1. An apparatus for cutting open and removing a sheet-like package material from a packaged object comprising can ends packaged in the package material, the apparatus comprising:

means for feeding the packaged object along a feeding path in a longitudinal direction thereof;

means for creating vacuum condition which is disposed along said feeding path and provided with a suction opening, said vacuum creating means drawing upwardly the package material of the packaged object to form a loop-like slackened portion of the package material extending in the longitudinal direction of the packaged object;

a cutter disposed in said vacuum creating means near said suction opening and adapted to cut open the slackened portion of the package material;

means for removing the cut-open package material from the packaged object; and means for pushing the packaged object toward a stationary stopper disposed at said removing means, said pushing means including a movable presser member for pressing a trailing end of the packaged object, a cylinder actuator having a cylinder and a piston, and a spring;

wherein one of said cylinder and said piston is connected to said movable presser member and the other of said cylinder and said piston is connected to a stationary member fixedly provided at said removing means through said spring.

2. The apparatus according to claim 1, further comprising a spring for pressing said movable presser member against the trailing end of the packaged object when actuation of said cylinder actuator is released.

3. The apparatus according to claim 1, wherein said feeding means comprises a pusher for pushing the trailing end of the packaged object, and a part of said movable presser member contacts the trailing end of the packaged object before said pusher is brought out of contact with the trailing end of the packaged object.

4. An apparatus for cutting open and removing a sheet-like package material from a packaged object comprising can ends packaged in the package material, the apparatus comprising:

means for feeding the packaged object along a feeding path in a longitudinal direction thereof;

means for creating vacuum condition which is disposed along said feeding path and provided with a suction opening, said vacuum creating means drawing upwardly the package material of the packaged object to form a loop-like slackened portion of the package material extending in the longitudinal direction of the packaged object;

a cutter disposed in said vacuum creating means near said suction opening and adapted to cut open the slackened portion of the package material;

means for removing the cut-open package material from the packaged object; and means for delivering an unpackaged object to a discharge conveyor, said delivering means including an inclined shoot, at least one stopper disposed at an intermediate portion of said inclined shoot, and guide means for guiding the unpackaged object from said stopper to said discharge conveyor;

wherein said guide means comprises a trough-like guide member for holding the unpackaged object, a lateral cylinder actuator for moving said guide member between said stopper and said discharge conveyor, and a vertical cylinder actuator for moving said guide member toward and away from the unpackaged object.

5. The apparatus according to claim 4, wherein said one of said stopper has a contact member at one end thereof, and said contact member contacts an upper part of the unpackaged object when said stopper is lowered.

6. An apparatus for cutting open and removing a sheet-like package material from a packaged object comprising can ends packaged in the package material, the apparatus comprising:

means for feeding the packaged object along a feeding path in a longitudinal direction thereof, said feeding means including a pusher for pushing a trailing end of the packaged object;

means for lowering said pusher so that said pusher returns to its original position below a succeeding packaged object to be pushed by said pusher, said lowering means including cam grooves comprising an upper and a lower cam grooves and connecting cam grooves for connecting said upper cam groove and said lower cam groove at both ends thereof, a cam follower provided on said pusher and movable in said cam grooves, and switching guides disposed at the respective junctions of three grooves for switching moving direction of said cam follower so that said cam follower moves along a return path different from a forward path;

means for creating vacuum condition which is disposed along said feeding path and provided with a suction opening, said vacuum creating means drawing upwardly the package material of the packaged object to form a loop-like slackened portion of the package material extending in the longitudinal direction of the packaged object;

a cutter disposed in said vacuum creating means near said suction opening and adapted to cut open the slackened portion of the package material; and means for removing the cut-open package material from the packaged object.

7. An apparatus for cutting open and removing a sheet-like package material from a packaged object comprising can ends packaged in the package material, the apparatus comprising:

means for feeding the packaged object along a feeding path in a longitudinal direction thereof;

means for positioning the packaged object having a folded portion on a circumferential surface of the package material, said positioning means including a pair of parallel elongate rollers for rotating the packaged object about a longitudinal axis thereof, and a sensor for detecting the folded portion of the packaged object;

means for creating vacuum condition which is disposed along said feeding path and provided with a suction opening, said vacuum creating means drawing upwardly the package material of the packaged object to form a loop-like slackened portion of the package material extending in the longitudinal direction of the packaged object;

a cutter disposed in said vacuum creating means near said suction opening and adapted to cut open the slackened portion of the package material; and means for removing the cut-open package material from the packaged object.

* * * * *